United States Patent [19]

Logan

[11] 4,431,886

[45] Feb. 14, 1984

[54] CIRCUIT-BREAKER

[75] Inventor: Robert J. Logan, Sheffield, England

[73] Assignee: Northern Engineering Industries plc, Great Britain

[21] Appl. No.: 396,798

[22] Filed: Jul. 9, 1982

[30] Foreign Application Priority Data

Aug. 12, 1981 [GB] United Kingdom ..... 8124645

[51] Int. Cl.[3] ..... H01H 33/04

[52] U.S. Cl. ..... 200/144 A; 200/147 R; 200/241

[58] Field of Search ..... 200/147 R, 147 A, 147 B, 200/241, 144 A, 240

[56] References Cited

U.S. PATENT DOCUMENTS 2,411,892 12/1946 Peters ..... 200/147 A 4,286,128 8/1981 Ruffieux et al. ..... 200/147 R

*Primary Examiner*—E. A. Goldberg

*Assistant Examiner*—Morris Ginsburg

[57] ABSTRACT

A circuit-breaker has a fixed contact, a movable contact and coil for rotating the arc. The compounds are mounted in a casing containing pressurized gas having arc-extinguishing properties. The fixed contact is connected to a second end of the coil, the first end of which is connected to a first terminal. The movable contact is carried by a hollow movable contact member which is electrically connected to a second terminal. The contact member has ports which control communication between a first chamber in the casing in which the fixed contact is located and a second chamber in the casing in dependence upon the position of the contact member. Ferromagnetic material is positioned adjacent the coil which is coaxial with the line of movement of the contact member.

9 Claims, 7 Drawing Figures

CIRCUIT-BREAKER

BACKGROUND TO THE INVENTION

The invention relates to circuit-breakers.

A circuit-breaker has been proposed in which a fixed contact in first chamber is engageable by a hollow movable contact and in which gas, such as sulphur hexafluoride $SF_6$, in the first chamber is thermally expanded upon the occurrence of an electric arc formed as the contacts are separated. The resultant flow of gas from the first chamber through the hollow moving contact to a second chamber is a blast of gas which extinguishes the arc.

The same proposal included the provision of a coil through which current flows after the arc has commutated from the fixed contact, the arc being made to rotate by a magnetic field caused by the current flowing in the coil. In that proposal one end of the coil is connected directly to one of the terminals of the circuit-breaker and the fixed contact is directly connected to the same terminal. The other end of the coil is connected to an electrode to which the arc commutates. No current therefore flows through the coil when the contacts are engaged.

In that proposal no magnetic field is available to rotate the arc until the arc has commutated and the proposal describes a coil having a relatively large number of turns which produce a magnetic field of relatively high strength.

The coil in that proposal is not associated with any ferromagnetic material to concentrate the magnetic field.

SUMMARY OF THE INVENTION

According to the invention a circuit-breaker comprises:

(a) wall means defining first and second chambers which contain pressurised gas having arc-extinguishing properties;

(b) first and second terminals mounted in said wall means;

(c) a fixed annular contact located in said first chamber;

(d) a movable annular contact engageable in butting relationship with said fixed contact and movable along a line of movement with which both said contacts are coaxial;

(e) a hollow movable contact member which carries said movable contact, said contact member extending through a part of said wall means separating said chambers and having ports controlling communication between said chambers in dependence upon the position of said contact member, said contact member being electrically connected to said second terminal;

(f) a coil coaxial with said line of movement of said contact member and having a first end connected to said first terminal and a second end connected to said fixed contact; and (g) a ferromagnetic body positioned adjacent said coil and positioned so that the least distance between said body and said movable contact is always greater than the least distance between said body and said fixed contact; and (h) mechanism operable to move said contact member along said line of movement to engage said movable contact with said fixed contact and then to turn said contact member angularly about said line of movement to turn said movable contact in wiping engagement with said fixed contact.

BRIEF DESCRIPTION OF THE DRAWINGS

A circuit-breaker will now be described by way of example to illustrate the invention with reference to the accompanying drawings, in which.

DESCRIPTION OF THE INVENTION

Figure 1:
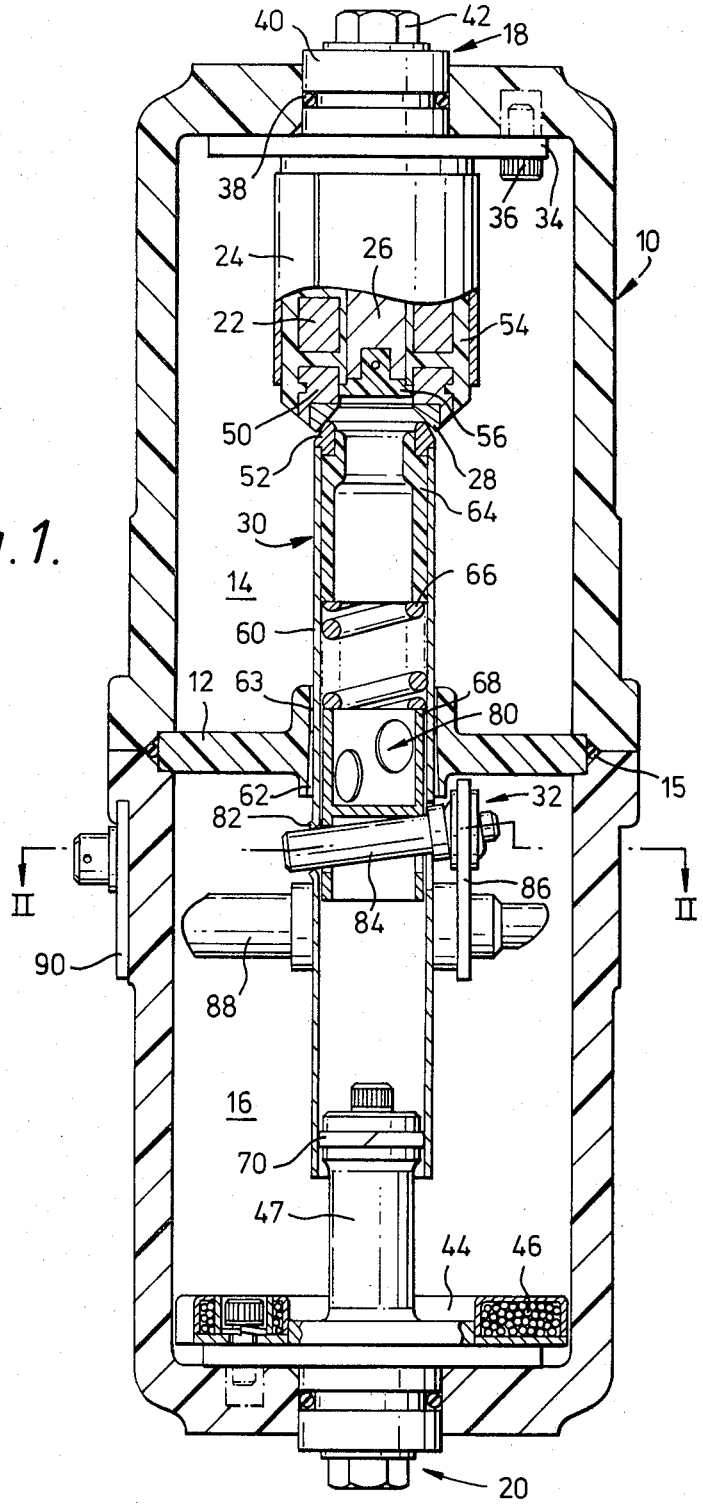
FIG. 1 is a vertical longitudinal section through the circuit-breaker.

The circuit-breaker shown in the drawings consists of the following main parts: a cylindrical casing 10 having an inner central annular wall 12 dividing the casing interior into upper and lower chambers 14, 16 respectively, of equal size; upper and lower terminal assemblies 18, 20, respectively; a coil 22 with an adjacent external ferromagnetic body 24 and internal body 26; a fixed contact 28; a movable contact assembly 30; and mechanism 32 operable to move the contact assembly 30.

The casing 10 and the wall 12 are of reinforced synthetic plastic material, for example epoxy resin filled with the fibrous material available from the Du Pont company under the trade name "KELVAR". The casing 10 is in two cup-shaped halves made as compression or injection mouldings and secured together by screws (not shown) passing through flanges (not shown) extending outwardly adjacent the mouths of the halves. The wall 12 is trapped between opposed annular shoulders adjacent the mouths of the halves and an O-ring seal 15 is positioned around the periphery of the wall 12 to complete the gas-tight assembly.

Figure 3:
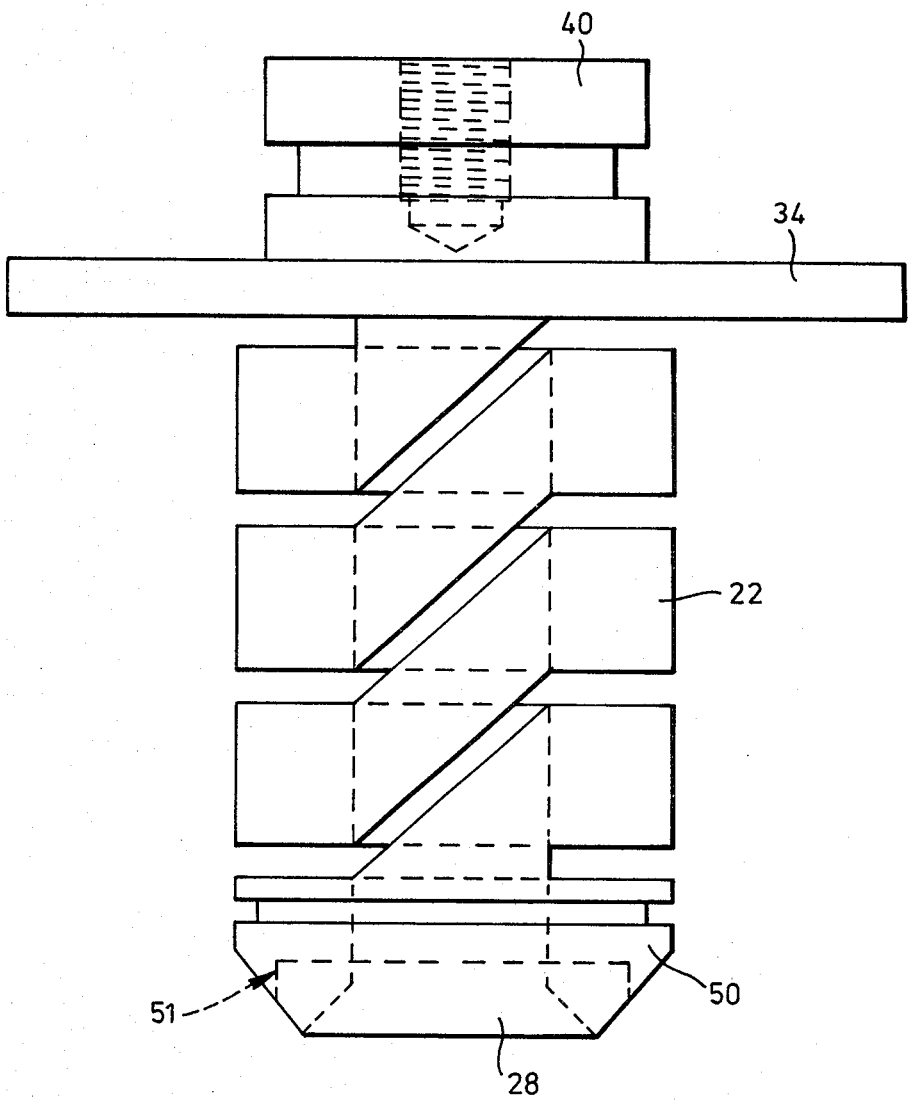
FIG. 3 is an elevation of part of a terminal assembly and of the coil together with the fixed contact shown in FIG. 1.

The upper terminal assembly 18 (see also FIG. 3) includes a copper plate 34 secured by screws 36 to the inner face of the upper end wall of the casing 10. An O-ring seal 38 is located in a circumferential groove in a central boss 40 integral with the plate 34 and engages the cylindrical surface of a central through-opening in the end wall. The boss 40 carries a screw 42 by which a conductor (not shown) can be secured to the terminal. The lower terminal assembly 20 is generally similar to the upper assembly 18, except that an annular perforated continer 44 is held against the lower terminal plate by the securing screws and contains getter material 46 to reduce or prevent the formation of hydrofluoric acid, which might be produced by electrical action on the gas contained in the casing 10, which is preferably sulfur hexafluoride. The lower assembly 20 also differs in that it includes a member in the form of a column 47 described below and in that it has an annular insert (not shown in FIG. 1 but as shown at 148 in FIG. 5) of polytetrafluoroethylene, for example, which cushions the engagement of the end of a tube 60 (described below) with the assembly 20.

Typically, the casing contains $SF_6$ at a pressure of four atmospheres, for example, (4 bar).

The coil 22 (and see FIG. 3) is integral with the plate 34 and consists of three substantially C-shaped parallel planar turns joined by short inclined sections. The coil is made by milling a tubular part integral with the plate 34.

The lower end of the coil 22 is integral with a complete ring 50, which has an inner annular recess 51 (FIG. 3) at its lower face in which is located the fixed contact 28 which is secured by brazing to the ring 50. The contact 28 is a ring of low-resistance alloy of silver tungsten carbide, as is the contact 52 of the movable contact assembly 30.

The coil 22 is encapsulated in epoxy resin 54, is surrounded by the body 24 which is a hollow iron cylinder.

The inner body 26 is an iron cylindrical core, which is protected by an end cap 56 of PTFE.

The movable contact assembly 30 includes a copper contact member in the form of a hollow cylindrical tube 60, which is slidable through a partly tapered opening 62 in a tubular enlargement 63 on the wall 12. The tube 60 carries the contact 52 at its upper end and contains a cylindrical PTFE sheath 64 partly overlying inside of the contact 52. The lower end of the sheath 64 forms a stop for the upper end of a coiled compression spring 66 located within the tube 60, the lower end of the spring 66 abutting a bush 68.

The lower end of the tube 60 is slidably guided by a contact ring 70 carried by the column 47 integral with the plate and boss of the lower terminal assembly 20, so that the movable contact assembly 30 is electrically connected to the lower terminal.

Figure 4:
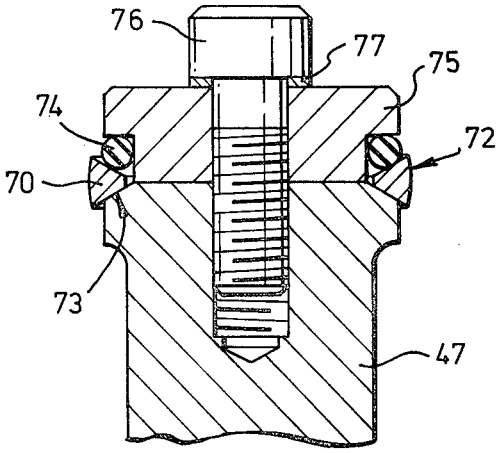
FIG. 4 is a scrap section through part of a lower terminal assembly shown in FIG. 1.

The column 47 and the ring 70 are shown in detail in FIG. 4. The ring 70 is of sulphur-copper and has a narrow open oblique slot right through it (FIG. 1) so that the ring 70 is resiliently expansible and compressible. The ring 70 has upper and lower frusto-conical side faces and a slightly barrel-shaped circumferential surface 72.

The upper end of the column 47 has an annular inclined and slightly convex shoulder 73, which is engaged by the lower frusto-conical surface of the ring 70. The upper frusto-conical surface of the ring 70 is engaged by an O-ring 74 of nitrile rubber, which is retained in position by an annular cap 75 secured to the column 47 by a central screw 76 and a single coil washer 77.

The O-ring 74 is compressed between an annular rebate-shaped abutment provided by the cap 75 and the ring 70 so as to provide a load on the ring 70 to maintain the ring 70 in 360° line engagement at the surface 72 with the interior surface of the tube 60, which is silver-plated so as to ensure good electrical contact between the ring 70 and the tube 60.

There is some 0.25 millimeters radial clearance between the tube 60 and the edge surface of the opening at 63 through the dividing wall 12. The barrel-shape of the surface 72 of the ring 70 and the compliance provided by the O-ring 74 and the convex surface 73 ensures that, in all positions of the tube 60, the 360° line contact between the tube 60 and the ring 70 is maintained. Currents of up to 45 kilo-amperes can successfully be passed through the line-contact between the ring 70 and the tube 60. Typically, for example, the ring 70 is loaded by the O-ring 74 so that the force necessary for relative dry sliding movement between the tube 60 and the ring 70 is 4.5 to 5.5 kilogrammes (10 to 12 pounds).

The bush 68 has several through-apertures 80 for gas flow and so has the tube 60, though the holes in the tube 60 are not visible in FIG. 1.

The tube 60 has an aperture within a slightly belled, annular portion 82 of the tube wall, in which aperture a pin 84 is located. The pin 84 is fixedly mounted on an arm 86 secured to an operating shaft 88 which extends out of the chamber 16 through the casing 10 at one side, and which carries an arm 90. The pin 84 passes through a smaller aperture in the sleeve 68 adjacent the belled portion 82 of the tube 60 and through larger adjacent apertures in the bush 68 and the tube 60 adjacent the arm 86.

Figure 2:
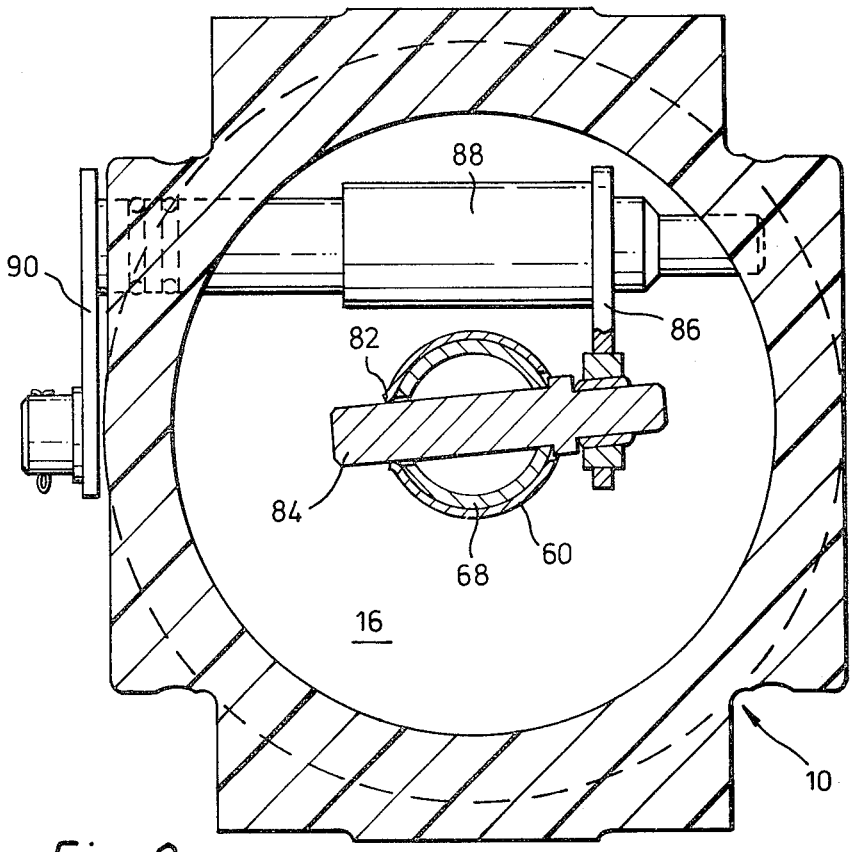
FIG. 2 is a section on the line II—II in FIG. 1.

The pin 84 is inclined to the planes of both FIGS. 1 and 2.

The means attached to the arm 90 for operating the circuit-breaker do not form part of the invention and need not be described.

OPERATION

In the position shown in FIGS. 1 and 2 the circuit-breaker is closed, the contact 28 being engaged by the movable contact 52 through which current is passed, typically (for example for application in underground mining workings) the circuit-breaker is rated at 3.3 kilo-volts for full rated current of 400 amperes, say.

The coil 22 is in series with the closed contacts and connects the fixed contact 28 to the upper terminal. The contacts 28 and 52 are pressed together under the compression load in the spring 66.

A magnetic field is produced by the coil 22 as current flows through the coil while the contacts 28 and 52 are closed. Consequently, the arc is subjected to the magnetic field as soon as it forms between the contacts 28 and 52 upon their separation. The arc interacts with the magnetic flux and is driven around the contacts so that the heat of the arc is not concentrated at one point on either contact. The presence of the ring 50 at the lower end of the coil 22 causes the magnetic flux to be out-of-phase with respect to the current so that the arc is subjected to a relatively high driving force, when the current is approaching zero, which assists in arc extinguishment.

The arc extends between the two contacts 28 and 52 and its roots remain on the contacts until the arc is extinguished.

The presence of the ferromagnetic bodies 24 and 26 enables the very few turns of the coil 22 to be effective. The contact 28 is sized and positioned in relation to the two bodies 24, 26 such that the circular path of the arc is stabilised and tendency of the arc to depart radially from that path is inhibited. As shown in FIG. 1, the least distance between the iron parts 24, 26 and movable contact 52, is always greater than the least distance between said parts 24, 26 and fixed contact 28.

The coil 22 is of relatively low resistance and with its associated ferromagnetic bodies 24, 26 does not present any major impedance to normal current flow through the closed circuit-breaker. The coil is designed to produce rotation of the arc sufficient to avoid damage to the contacts 28, 52 by excessive temperatures resulting from lack of arc motion.

After separation of the contacts 28, 52 the pressure of the $SF_6$ gas in the chamber 14 rises as the contacts continue to separate. The communication between the chamber 14 and the chamber 16 is progressively opened through the ports in the tube 60 and the ports 80.

The contact 28 is shaped to direct gas flow through the path of the arc, as a path for gas to flow out of the chamber 14 is progressively opened by the movement of the contact tube member 60 so as to move the apertures in the tube and the apertures 80 out of the shrouding effect of the tubular enlargement 63.

Gas flows rapidly down through the tube 60 into the chamber 16 and in so doing extinguishes the arc. The internal diameter of the tube 60 is chosen to ensure adequate gas velocity. The apertures in the tube 60 are chosen so that the difference between the pressures in the two chambers 14 and 16 rises sufficiently quickly to ensure adequate gas flow and velocity.

Under normal operating conditions where the arc is extinguished at the second current zero following separation of the contacts, a typical duration of the arc is 15 milliseconds.

When the circuit-breaker is fully open the gap between the contacts 28 and 52 is some 30 millimeters and the arm 86 is downwardly directed. The pin 84 is inclined upwardly from the arm 86 towards the left, the bush 68 occupying a lower position in relation to the tube 60. The spring 66 is at its most relaxed but is still under some pre-load.

To close the circuit-breaker the shaft 88 is turned to raise the arm 86 to move the pin 84 towards the positions shown in FIGS. 1 and 2. In so moving the pin 84 changes its inclination, as seen in FIG. 2, anti-clockwise about the centre of the tube 60. This movement causes the tube 60 and the bush 68 to turn similarly. The contact 52 engages the contact 28 before the turning movement is complete so that, in the last part of the movement, the bush 68 moves upwards some 6 millimeters relatively to the stationary tube 60, slightly increasing the load in the spring 66 and maintaining the contact 52 pressed against the contact 28. The tube 60 is still turning during this last part of the movement so that a slight rotary wiping action is imparted to the contact 52, which enhances the degree of electrical contact with the contact 28 and reduces the contact resistance.

In modifications (not shown): (i) the casing may be of polyester instead of epoxy resin; (ii) the coil may be a multi-start coil instead of single-start as described; (iii) a puffer piston-and-cylinder mechanism may be added, relative movement between the piston and cylinder being produced by movement of the movable contact so that gas flow is assisted by the puffer action.

In the circuit-breaker described above with reference to the drawings, the pressure of $SF_6$ gas typically rises to some eight atmospheres (8 bar) owing to heating of the gas by the arc and the casing 10 is preferably capable of withstanding pressures up to 40 atmospheres (40 bar), for example.

Figure 5:
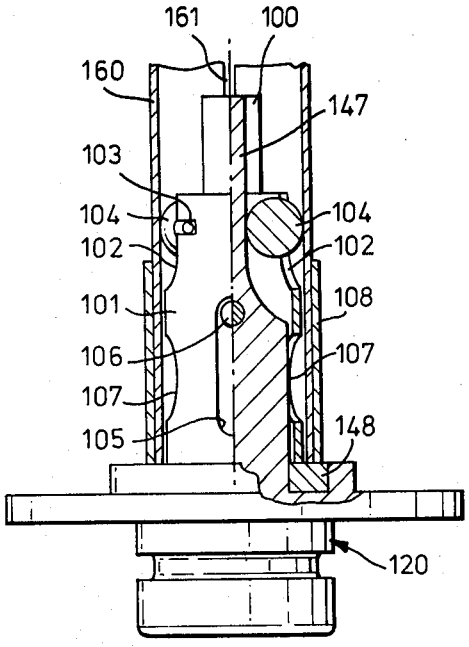
FIGS. 5 and 6 are views, partly in section on lines V—V and VI—VI in FIG. 7, respectively, showing a modified electrical contact arrangement, between a lower part of the contact member and the lower terminal assembly, the arrangement being shown, in FIG. 5, in the positions occupied when the contacts are open and, in FIG. 6, in the positions occupied when the contacts are closed.
Figure 6:
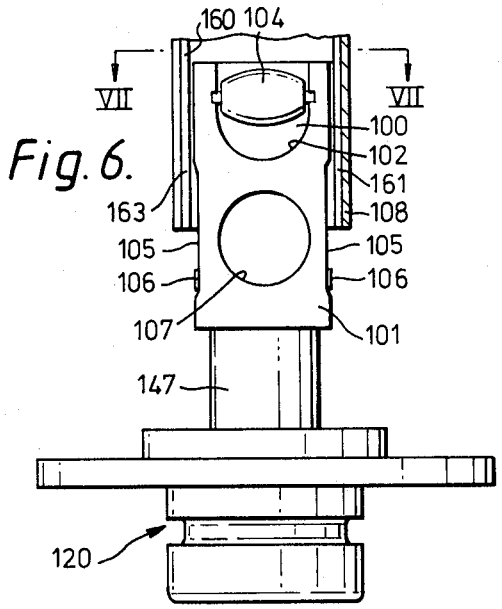
Figure 7:
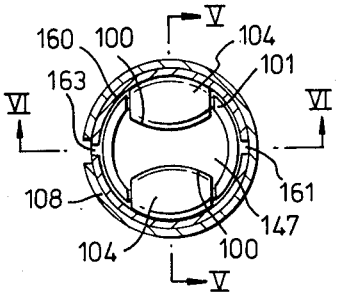
FIG. 7 is a section on line VII—VII in FIG. 6.

The modified electrical contact arrangement shown in FIGS. 5, 6 and 7 will now be described. The terminal assembly 120 of the arrangement is similar to the assembly 20 shown in FIG. 1. However, the column 147 of the assembly 120 is shaped so as to have, over a major portion of its length, oppositely-facing surfaces 100 which are, in cross-section (see FIG. 7), concave.

A tubular, brass roller-cage 101 is located coaxial with, and around, the column 147. The roller-cage 101 has oppositely-located apertures 102 into each of which a pair of circumferentially-extending slots 103 open. A barrel-shaped, copper roller 104 is mounted for rotation in each aperture 102 by end-pins which are located in the slots 103. The surfaces of the rollers 104 are complimentary to the surfaces 100 on the column 147. The roller-cage 101 has a pair of elongate slots 105 in which are located the ends of a pin 106 passing through the column 147 whereby movement of the roller-cage 101 relative to the column 147 is limited. The roller cage 101 has a further pair of apertures 107 to lessen the weight of the roller-cage 101.

The tube 160 of the movable contact assembly 30 is similar to the tube 60. However, the tube 160 has a pair of slots 161, 163 on opposite sides, the slot 161 extending from its bottom up to the larger of the apertures accommodating the pin 84 and the slot 163 stopping short of the smaller of said apertures and ending in a stress-relieving hole (not shown). A C-section spring sleeve 108 surrounds the lower end of the tube 160. The sleeve 108 presses the tube 160 into positive contact with the rollers 104 which are pressed, in turn, against the surfaces 100 on the column 147. The sleeve 108 is fixed relatively to the tube 160.

During operation of the circuit-breaker, the rollers 104 roll in contact with the surfaces 100 and the tube 160 and move linearly approximately half the distance that the tube 160 moves.

What I claim is:

1. A circuit-breaker comprising:

(a) wall means defining first and second chambers which contain pressurised gas having arc-extinguishing properties;

(b) first and second terminals mounted in said wall means;

(c) a fixed annular contact located in said first chamber;

(d) a movable annular contact engageable in butting relationship with said fixed contact and movable along a line of movement with which both said contacts are coaxial;

(e) a hollow movable contact member which carries said movable contact and movable along said line of movement, said contact member extending through a part of said wall means separating said chambers and having ports controlling communication between said chambers in dependence upon the position of said contact member, said contact member being electrically connected to said second terminal;

(f) a coil coaxial with said line of movement of said contact member and having a first end connected to said first terminal and a second end connected to said fixed contact;

(g) a ferromagnetic body positioned adjacent said coil and positioned so that the least distance between said body and said movable contact is always greater than the least distance between said body and said fixed contact; and (h) mechanism operable to move said contact member along said line of movement to engage said movable contact with said first contact and then to turn said contact member angularly about said line of movement to turn said movable contact in wiping engagement with said fixed contact.

2. A circuit-breaker according to claim 1, in which said coil is integral with said first terminal.

3. A circuit-breaker according to claim 1 or claim 2, in which said coil is a single-start coil consisting of three substantially C-shaped parallel planar turns joined by short inclined sections.

4. A circuit-breaker according to claim 1 or claim 2, in which said fixed contact is secured to a complete ring integral with said coil.

5. A circuit-breaker according to claim 1, in which said ferromagnetic body comprises two parts, one part being a cylindrical core positioned within said coil and the other part being a hollow cylinder surrounding said coil.

6. A circuit-breaker according to claim 1, in which said mechanism comprises a shaft angularly reciprocable about an axis disposed transversely to and offset from said line of movement of said contact member, an arm fixed at a first end thereof to said shaft for rotation therewith and a pin fixed at a second end of said arm, said contact member having abutment surface means engaged by said pin, said pin being inclined to said arm such that said pin is always inclined to one or other of planes which contain said axis and which are parallel to and normal to said line of movement, respectively, said abutment surface means including an abutment member movable relatively to said contact member and engaged by said pin, spring means being interposed between said abutment member and said contact member, rotation of said shaft through an end part of the total angular stroke thereof being effective to turn said movable contact about said line of movement in wiping engagement with said fixed contact and also being effective to move said abutment member along said line of movement relatively to said contact member.

7. A circuit-breaker according to claim 1, in which said second terminal includes a column coaxial with said line of movement of said contact member, said column extending at least partly within said contact member.

8. A circuit-breaker according to claim 7, in which a C-shaped ring is supported by said column, said ring having a circumferential barrel-shaped external surface slidably engaging said contact member and two annular side-faces which diverge from one another towards said external surface, one side-face engaging an annular shoulder on said column and the other side-face being engaged by an O-ring of resilient material which is compressed between said ring and an abutment on said column.

9. A circuit-breaker according to claim 7, in which said contact member has a split extending over part of the length thereof and has a C-shaped spring sleeve compressing said contact member in the region of said split and in which a roller-cage carrying rollers is located over said column, said contact member being pressed into contact with said rollers and said rollers, in turn, being pressed into contact with complimentarily-shaped surfaces on said column by action of said spring sleeve on said contact member.

* * * * *